US007121381B2

(12) United States Patent
Shai

(10) Patent No.: US 7,121,381 B2
(45) Date of Patent: Oct. 17, 2006

(54) MOVE-ON LADDER SYSTEM

(76) Inventor: Moti Shai, 3524 Via del Prado, Calabasas, CA (US) 91302

( * ) Notice: Subject to any disclaimer, the term of this patent is extended or adjusted under 35 U.S.C. 154(b) by 84 days.

(21) Appl. No.: 10/890,446

(22) Filed: Jul. 15, 2004

(65) Prior Publication Data

US 2004/0245045 A1 Dec. 9, 2004

Related U.S. Application Data

(63) Continuation of application No. 10/171,100, filed on Jun. 13, 2002, now abandoned.

(51) Int. Cl.
*E04G 1/34* (2006.01)
*E04G 1/00* (2006.01)
*E06C 1/00* (2006.01)

(52) U.S. Cl. ..... 182/152; 182/20; 182/163; 182/22

(58) Field of Classification Search ..... 182/134, 182/92, 152, 93, 194, 156, 163, 120, 180.1, 182/230, 12–17, 21, 22, 25
See application file for complete search history.

(56) References Cited

U.S. PATENT DOCUMENTS 2,798,652 A * 7/1957 Easton ..... 182/17
3,282,376 A * 11/1966 Merriman ..... 182/17
3,641,619 A * 2/1972 Roylance ..... 182/15
3,817,347 A * 6/1974 Spencer ..... 182/115
3,968,858 A * 7/1976 Vollan et al. ..... 182/135
4,310,070 A * 1/1982 Mastrogiannis ..... 182/134
4,442,919 A * 4/1984 Fulcher ..... 182/63.1
4,911,263 A * 3/1990 Kuperman ..... 182/13
5,481,988 A * 1/1996 Dess ..... 280/35
5,860,490 A * 1/1999 Petti et al. ..... 182/134
6,173,811 B1 * 1/2001 Tornabene et al. ..... 182/20
6,651,774 B1 * 11/2003 Yoo ..... 182/20
6,880,835 B1 * 4/2005 Tornabene et al. ..... 182/20

* cited by examiner

*Primary Examiner*—Hugh B. Thompson, II

(57) ABSTRACT

A system and method for providing an improved ladder for enabling a user to climb up or down and forward or backwards movement relative to a surface. The system enables increased mobility and stability. The system can be designed in multiple ways which some of them have been shown in the present invention. The present invention clearly saves production time, keeping the user on the ladder while relocating, and it definitely more convenient and time saving to the user.

4 Claims, 4 Drawing Sheets

MOVE-ON LADDER SYSTEM

CROSS REFERENCE TO RELATED APPLICATIONS

This is a continuation of appliction Ser. No. 10/171,100 fied Jun. 13, 2002, now abandoned

BACKGROUND OF THE INVENTION

1. Field of the Invention

The present invention relates generally to improvements in devices for enabling a user to climb up or down, forward or backwards relative to a surface. In particular, it relates to a new and improved system and method for providing a move-on ladder.

2. Description of the Related Art

The systems and methods of the present invention are particularly useful for enabling efficient, effective and increased mobility forward or backwards movements relative to a surface while the user is on the ladder. The present invention clearly saves production time, keeping the user on the ladder while relocating, and it definitely more convenient and time saving to the user.

A variety of systems and methods have been unsuccessfully developed over the years for providing alternatives to walking while on the ladder.

It would be desirable to provide a ladder which enables the user great forward or backwards mobility, on a non smooth surface floor, without requiring the user to step down from it.

It would be desirable to provide a rungless ladder which contains less material and parts for increased economy and efficiency, which is lighter in weight for greater forward or backwards mobility and which provides a place holder to necessary working tools and materials.

Therefore, the present invention provides improved systems and methods for providing and efficient, effective and increased mobility, without requiring the user to step down from it, ladder. The inventions described herein satisfy these and other needs.

SUMMARY OF THE INVENTION

Briefly and in general terms, the present invention provides a new and improved system and method for enabling the user forward and backwards mobility relative to a surface. The present invention can also be configured to facilitate an economical and efficient system.

More particularly, for example, in one embodiment—dual-ladder, of the present invention is provided to enable the user great forward or backwards mobility, on a smooth and non smooth surface floor, without requiring the user to step down from it. Further, the system includes pair of narrow ladders, one for each user foot, attached to the main frame and connected to each other by flat straps pivotally attaching pair of ladders to the pivotally rotating steering strap which attached to the pipe which is pivotally attached to the further legs of the system. To increase mobility the system further includes pair of wide rubber wheels which are attached to the bottom of each of the narrow ladders and pair of wheel which each of them attached to the further leg of the system. Weight on the narrow ladders prevent from wide rubber to function. The system allows the user to "Walk the ladder" by pushing one leg at a time.

Second embodiment—rungless ladder, of the present invention, a rungless ladder system, which contains less material and parts for increased economy and efficiency, is provided for enabling the user to climb up or down, forward or backwards movements relative to a surface and which provides a tray to necessary working tools and materials which telescopically expanded to required height. Further, the system includes a pair of pedals, each adapted to enable the user to slidably move along the track and to engage with or release from the track. Each of the pair of pedals includes a slidable-movement-enabling element, for enabling slidable movements of the pedal along the track responsive to user movement thereof.

Each pedal also includes a track-engaging element, for enabling the pedal to engage the track responsive to user movement of the pedal into a track-engaging position, and for enabling the pedal to release from engaging with the track responsive to user movement of the pedal to a track-releasing position.

DETAILED DESCRIPTION OF THE PREFERRED EMBODIMENTS

The present invention is directed to an improved system and method for enabling a user to climb up or down and step forward or backwards for movement while the user is on the ladder, relative to a surface, in an efficient and effective manner. The invention has 3 different models; the $1^{st}$ one is called a dual-ladder system which enables the user great forward or backwards mobility, also on a non smooth surface floor. The $2^{nd}$ model is called the rungless ladder system, which contains less material and parts than conventional ladder for increased economy and efficiency, for enabling the user to climb with a pedal on a track, up or down, and which provides tools tray which telescopically expanded to required height. The $3^{rd}$ model is called a poll wheel ladder, by placing the polls on the front of the ladder and then pulling them back in a "ski" like movement and by that moving the ladder forward. The preferred embodiments of the improved system and method are illustrated and described herein by way of example only and not by way of limitation.

Figure 1:
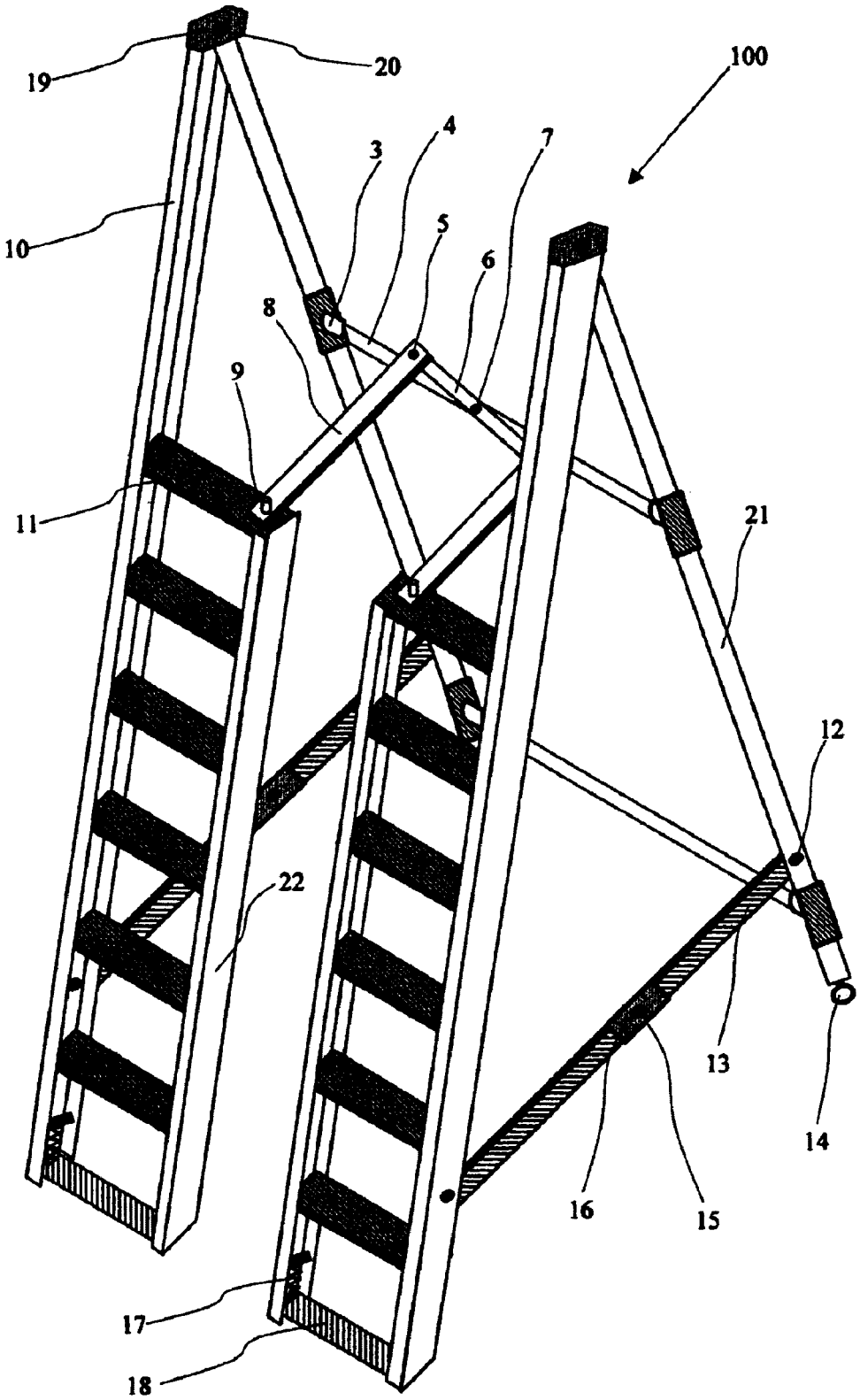
FIG. 1 is a perspective view of the main embodiment: dual-ladder.

In the drawing, wherein like reference numerals denote like or corresponding parts throughout the drawing figures, and particularly in the preferred embodiments in accordance with the invention as shown in FIG. 1, for example, a system 100 is provided to enable the user great forward or backwards mobility, on a smooth and non smooth surface floor, without requiring the user to step down from it and without using his hands, constituting a dual-ladder.

As illustrated in FIG. 1, in a preferred embodiment in accordance with the present invention, for example, the system 100 includes frame front struts 10, pair of narrow rung sets 11 and ladders side support struts 22. To increase mobility the system further includes pair of wide rubber wheels 18 which are attached to the bottom of each of the narrow rung sets 11. Spring 17 pushes wide wheels 18 out when the weight on narrow rung sets 11 is released. Bi-folding strap 13 attached to the front struts 10 and ladder back pipes 21 by pins 12. Bi-folding strap 13 has a middle lock 16 which attached to strap 13 by pin 15 which allows the ladder to be folded. Pair of conventional wheels 14 attached to the bottom of back pipes 21. Flat strap 8, which attached to the top of the rung, sets 11 by built-in pin 9, connected to the middle strap 6 by pin 5. Middle strap 6 is connected to support pipe 4 by pin 7. Rubber cap 19 is located on the top of the ladder includes pin 20 which connects the strut 10 and the back pipes 21 and allows the ladder to be folded. Set of 4 vertical "T" shaped hinges 3, located at the top and bottom of back pipes 21, provide ladder frame support and connection between twp "A" shaped frames and these hinges 3 allow ladder parts to move freely in all the necessary direction, so the ladder can move forward and backwards. "T" shaped hinges 3 also allow support pipe 4 to rotate so straps 8 will be pull down when the ladder need to be folded.

Figure 2:
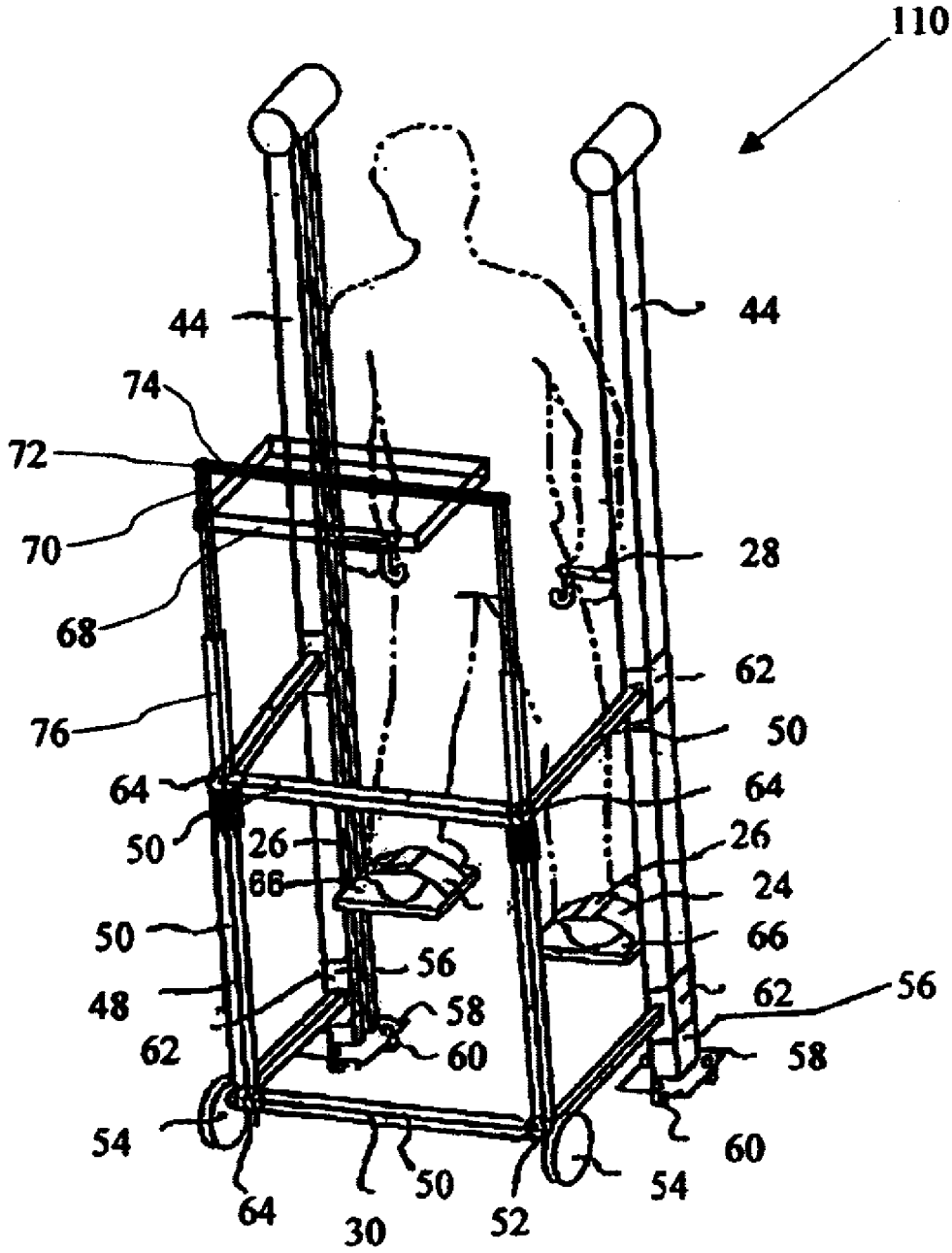
FIG. 2 is a perspective view of the second embodiment: rungless ladder with telescopic tray, with a user shown in dashed lines, in accordance with the present invention.

As illustrated in FIG. 2, in another embodiment in accordance with the present invention, the system 110 includes the pair of parallel and spaced-apart tracks 44, and the support 30 comprises a frame support 48. The frame support 48 is generally rectangular shaped, is comprised of a plurality of struts 50, and includes a pair of bottom corners 52, and a pair of wheels 54 at the bottom corners 52. The pair of tracks 44 each includes a bottom portion 56, and a pad 58 at the bottom portion 56 for stability. Each pad 58 further includes a plurality of spring-loaded wheels 60, for flexibility in movement of the tracks 44. When the user presses down on the pedals 66, the spring-loaded wheels 60 are compressed down, preventing movement thereon. When the user lifts up on the pedals 66, the spring-loaded wheels 60 are released from compression thereof, enabling slidable rolling movement thereon. The tracks 44 include plurality of hinges 62, and the frame support 48 includes a plurality of hinge connectors 64, each of which may comprises for example a pin engaging a rounded end of strut 50, interconnecting the plurality of struts 50, for enabling hingedly-connected movement of the system 110, The hinges 62 of the tracks 44 and the hinged connectors 64 of the plurality of struts 50 enable the frame support 48 and the tracks 44 to which they are connected to pivot upon movement of the pedals 66 by the user, such that the user may move one side track 44 forward or backward, and then the other side track 44 forward or backward, as desired, to enable movement of the system 110. The system provides pair of vertical telescopic struts 70 which connected to horizontal strut 74 by hinge connectors 72. Horizontal strut 74 holds tools tray 68.

Figure 3:
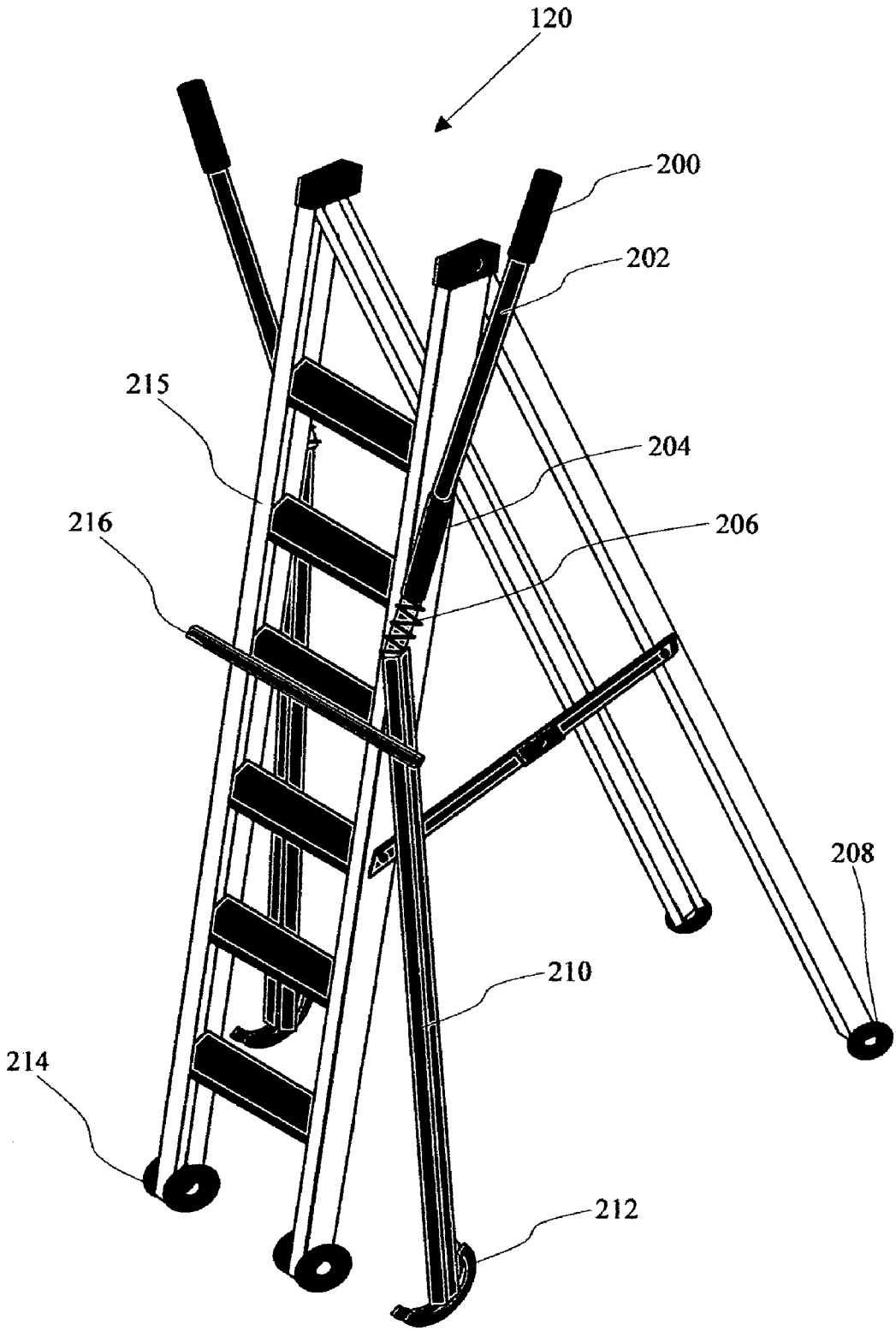
FIG. 3 is a perspective view of the third embodiment: poll wheel ladder.
Figure 4:
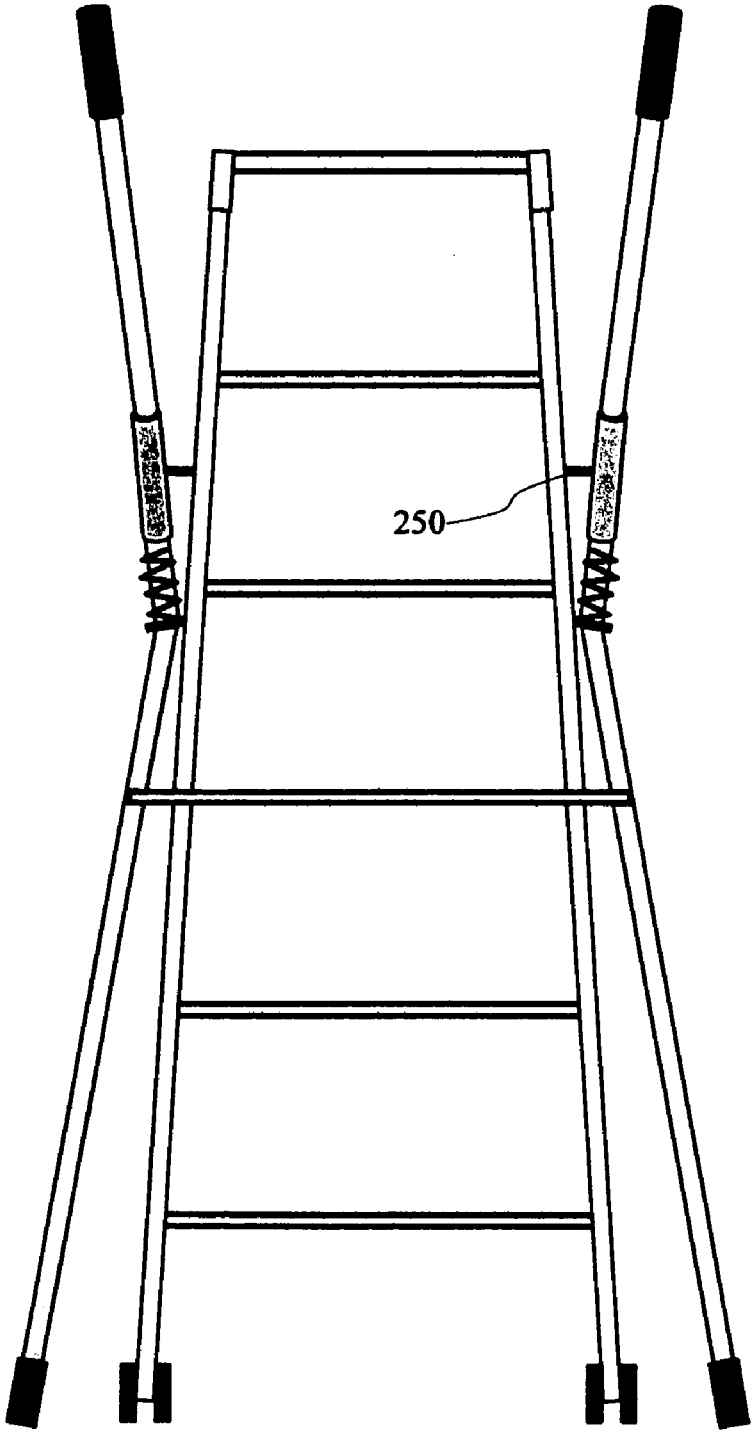
FIG. 4 is a front view of the third embodiment: poll wheel ladder, which clearly shows the curvy shape of the polls and arm guides.

As illustrated in FIGS. 3–4, in another embodiment in accordance with the present invention, the system 120 includes double wheels 214 located at the bottom of each of the closer ladder leg of the "A" shaped frame 215 and a single wheel 208 is located at the bottom of the farthest legs of the "A" shaped frame 21S. Round polls 202 located one on each said of the "A" shaped frame. Round polls guide 204 pivotally attached to the sides of the "A" shaped frame by pin 250, best shown in FIG. 4. "Moon" shaped sandals 212 are located at the bottom of each of the rectangular parts of poll 210. Top of each poll has a rubber handle 200. A strap stopper 216 is located on the closer legs of the "A" shaped frame 215. Spring 206 is located between the round pole 202 and the round polls guide 204.

Referring to FIG. 1, in a method for the use of a preferred embodiment in accordance with the present invention, called a dual ladder, the system 100 enables the user great forward or backwards mobility, on a smooth and non smooth surface floor, without requiring the user to step down from it and without using his hands. The user is "walking" system 100 by transferring his weight to one foot standing on one of the narrow rungs set and pushing the other narrow rungs set by other foot. User can travel forward or backward by pooling or pushing the "A" shaped frame by his hands.

Mobility of the ladder is provided by the fact that the system has plurality of wheels under every leg and privately connected hinge connectors systems. The system is foldable by releasing flat straps 8 from pins 9 and by pooling up middle lock 16.

Referring to FIG. 2, in a method for the use of another embodiment in accordance with the present invention, called a rungless ladder, the system 110 enables a user to use the frame support 48 by pivoting the parallel and spaced-apart tracks 44 and moving the tracks 44 on the wheels 54 and the spring-loaded wheels 60 on the pads 68 to the desired position, with additional flexibility while moving the tracks 44 providing by the hinged connectors 62, and then the user may support the tracks 44 on the pads 58. To turn, the user may move one track forward in a big step, and move the other track accordingly to the desired position. The user may pull up, or push down the tray 68 with the telescopic bar 70 in relation to the user's height for convenience.

Referring to FIGS. 3–4, in a method for the use of another embodiment, called a poll wheel ladder, the system 120 enables a user to climb up or down and great forwards or backwards mobility by placing the polls on the front of the ladder, then pulling them back in a "ski" like movement, it pushes the ladder forward. The strap stopper 216 limits the polls 210 backwards movement and positions polls 210 in their lock position after which polls 210 provide ladder support because the closer wheels 214 can not function. "Moon" shaped sandals 212 are located at the bottom of each rectangle poll 210, provides smooth and easy movement. The spring 206, absorbs the different heights when the ladder is not on a level surface. This system is substantially safe because it is supported by four legs and two polls. The system allows optional addition of the electric motor, operated by built-in battery, to create forward and backwards mobility activated by remote control or switch.

In view of the above, it is apparent that the system and the method of the preferred embodiments of the present invention enhance substantially the effectiveness if enabling a user to be supported for enabling movement up, down, forward, and backwards in relation to a surface. The system and method further enable convenient.

While the present invention has been described in connection with the specific embodiments identified herein, it will be apparent to those skilled in the art that many alternatives, modifications and variations are possible in light of the above description. Accordingly, the invention is intended to embrace all such alternatives, modifications and variations as may fall within the spirit and scope of the inventions disclosed herein.

What is claimed is:

1. A safe and stable ladder adapted to enable a user to vertically ascend or descend and provide forward or backward movement thereof, the ladder comprising:

a) a pair of foldable parallel frames, each frame containing a vertical climbing member and a vertical support member, each of the members having top and bottom ends;

b) a folding means for folding said ladder;

c) a climbing means affixed to the each of vertical climbing members for enabling the user to climb up or down the vertical climbing members;

d) a hinge system comprising at least two matching hinges on each of the vertical support members, said matching hinges being able to freely rotate about a longitudinal axis of the vertical support members to which they are attached, and a rigid bar interconnecting each respective pair of said matching hinges, and oriented perpendicular to the longitudinal axis of the vertical support members such that the parallel frames are connected and can be moved relative to each other;

e) a pair of wheels attached to the bottom ends of the respective vertical support members;

f) a pair of spring loaded wheels attached to the bottom ends of the respective vertical climbing member, said pair of spring loaded wheels being capable of rotation only when the user exerts no downward force on the respective vertical climbing member to which said spring loaded wheel is attached;

g) a rectangular frame removably attached and hingedly affixed to both an additional rigid bar and to a top of the climbing means, for providing additional structural support thereto; and wherein a user may climb up or down the parallel frames via the climbing means, and move the ladder forward or backward by moving one of said parallel frames forward or backward while the user places his weight upon the other of said parallel frames.

2. The ladder of claim 1 wherein said climbing means comprises a pair of rung sets attached to the respective vertical climbing means.

3. The ladder of claim 2 wherein said parallel frames are "A" shaped.

4. The ladder of claim 3 wherein said folding means are hinges connecting said top ends of said vertical support members to corresponding top ends of the vertical climbing members of each of said parallel frames.

* * * * *